US009129463B2

(12) United States Patent
Langhuber et al.

(10) Patent No.: US 9,129,463 B2
(45) Date of Patent: Sep. 8, 2015

(54) METHOD FOR FILLING AT LEAST ONE THIN-WALLED TRANSPORT CONTAINER WITH AT LEAST ONE VALUABLE OBJECT AND DEVICE FOR SAFEKEEPING AT LEAST ONE VALUABLE OBJECT

(75) Inventors: Dirk Langhuber, Paderborn (DE); Günter Holland-Letz, Paderborn (DE)

(73) Assignee: Wincor Nixdorf International GmbH (DE)

( * ) Notice: Subject to any disclaimer, the term of this patent is extended or adjusted under 35 U.S.C. 154(b) by 1125 days.

(21) Appl. No.: 13/133,918

(22) PCT Filed: Dec. 8, 2009

(86) PCT No.: PCT/EP2009/066641

§ 371 (c)(1),
(2), (4) Date: Jul. 8, 2011

(87) PCT Pub. No.: WO2010/066741

PCT Pub. Date: Jun. 17, 2010

(65) Prior Publication Data

US 2012/0167529 A1 Jul. 5, 2012

(30) Foreign Application Priority Data

Dec. 10, 2008 (DE) ..... 10 2008 061 530

(51) Int. Cl.

| | |
|---|---|
| ***G07D 11/00*** | (2006.01) |
| ***B65B 11/08*** | (2006.01) |
| ***B65B 25/14*** | (2006.01) |
| ***B65B 67/04*** | (2006.01) |

(52) U.S. Cl.

CPC ..... *G07D 11/0009* (2013.01); *B65B 11/08* (2013.01); *B65B 25/14* (2013.01); *B65B 67/04* (2013.01); *B65H 2405/311* (2013.01); *B65H 2701/1912* (2013.01)

(58) Field of Classification Search

CPC ..... B65B 67/12; B65B 51/146; B65B 43/54; B65B 67/04; B65B 25/14; B65B 11/08; B65H 2701/1912; B65H 2405/311; G07D 11/0012; G07D 11/0009; G07D 11/0006

USPC ..... 53/459, 469, 570, 575, 577, 284.7, 390

See application file for complete search history.

(56) References Cited

U.S. PATENT DOCUMENTS

| | | | | |
|---|---|---|---|---|
| 2,939,259 | A * | 6/1960 | Heckler | 53/459 |
| 3,343,334 | A | 9/1967 | Bode et al. | |

(Continued)

FOREIGN PATENT DOCUMENTS

| | | |
|---|---|---|
| CN | 2168294 Y | 6/1994 |
| CN | 101388122 A | 3/2009 |

(Continued)

*Primary Examiner* — Stephen F Gerrity

(74) *Attorney, Agent, or Firm* — Harness, Dickey & Pierce, P.L.C.

(57) ABSTRACT

A method for filling at least one thin-walled transport container with at least one article of value, in which a frame having an opening is contacted by a part of the outside surface of a transport container, which outside surface is turned inside. A part of the transport container is moved through the opening of the frame in the feeding direction of the article of value during filling so that at least a part of the inside surface of the transport container that is turned outside is turned inside.

17 Claims, 6 Drawing Sheets

(56) References Cited

U.S. PATENT DOCUMENTS

| | | | | | |
|---|---|---|---|---|---|
| 3,550,662 | A | * | 12/1970 | Remke et al. | 53/390 |
| 3,988,873 | A | * | 11/1976 | Oliverius | 53/469 |
| 4,042,267 | A | | 8/1977 | Clinch et al. | |
| 4,175,604 | A | | 11/1979 | Bonner | |
| 4,223,510 | A | * | 9/1980 | Cash | 53/258 |
| 4,296,529 | A | | 10/1981 | Brown | |
| 4,493,179 | A | * | 1/1985 | Brak | 53/577 |
| 4,505,095 | A | | 3/1985 | Short, Sr. | |
| 4,572,251 | A | * | 2/1986 | Drury | 53/390 |
| 4,651,505 | A | * | 3/1987 | Gropper | 53/469 |
| 4,964,739 | A | | 10/1990 | Branson et al. | |
| 4,993,210 | A | * | 2/1991 | Kollross | 53/469 |
| 5,123,535 | A | * | 6/1992 | Patnode et al. | 206/438 |
| 5,483,784 | A | * | 1/1996 | Owensby et al. | 53/459 |
| 5,600,978 | A | | 2/1997 | Netto | |
| 5,711,138 | A | * | 1/1998 | Yamamoto | 53/390 |
| 5,850,966 | A | | 12/1998 | Siler et al. | |
| 6,004,032 | A | | 12/1999 | Kapperman et al. | |
| 6,076,566 | A | | 6/2000 | Lowe | |
| 6,318,053 | B1 | * | 11/2001 | Frank et al. | 53/586 |
| 2002/0170275 | A1 | * | 11/2002 | Salman et al. | 53/459 |
| 2004/0035090 | A1 | * | 2/2004 | Thomsen | 53/459 |
| 2009/0066017 | A1 | | 3/2009 | Matsuse et al. | |
| 2010/0185317 | A1 | | 7/2010 | Aso et al. | |
| 2011/0031308 | A1 | | 2/2011 | Holland-Letz et al. | |
| 2011/0042889 | A1 | | 2/2011 | Holland-Letz et al. | |
| 2011/0052363 | A1 | | 3/2011 | Brexel et al. | |

FOREIGN PATENT DOCUMENTS

| | | | | | |
|---|---|---|---|---|---|
| CN | 101789147 | A | | 7/2010 | |
| DE | 2345151 | A1 | | 3/1975 | |
| DE | 2550135 | A1 | | 8/1976 | |
| DE | 3302074 | A1 | | 7/1984 | |
| DE | 4224223 | A1 | | 1/1994 | |
| DE | 102004037583 | A1 | | 3/2006 | |
| DE | 102008018935 | A1 | | 10/2009 | |
| DE | 102008018961 | A1 | | 10/2009 | |
| DE | 102008023900 | A1 | | 11/2009 | |
| EP | 0113874 | A1 | | 7/1984 | |
| EP | 0257978 | A2 | | 3/1988 | |
| EP | 0323706 | A2 | | 7/1989 | |
| EP | 0559630 | A1 | | 9/1993 | |
| EP | 1503351 | A2 | | 2/2005 | |
| GB | 2439809 | A | | 1/2008 | |
| JP | 01-279002 | A | | 11/1989 | |
| WO | WO-9319992 | | | 10/1993 | |
| WO | WO-9622922 | | | 8/1996 | |
| WO | WO 0149566 | A1 | * | 7/2001 | B65B 31/04 |

* cited by examiner

METHOD FOR FILLING AT LEAST ONE THIN-WALLED TRANSPORT CONTAINER WITH AT LEAST ONE VALUABLE OBJECT AND DEVICE FOR SAFEKEEPING AT LEAST ONE VALUABLE OBJECT

CROSS-REFERENCE TO RELATED APPLICATIONS

This application is a U.S. National Stage Application of International Application No. PCT/EP2009/066641, filed Dec. 8, 2009, and published in the German language as WO/2010/066741 on Jun. 17, 2010. This application claims the benefit and priority of German Application No. 10 2008 061 530.7, filed Dec. 10, 2008. The entire disclosures of the above applications are incorporated herein by reference.

BACKGROUND

This section provides background information related to the present disclosure which is not necessarily prior art.

1. Technical Field

The invention relates to a method for filling at least one thin-walled transport container with at least one article of value. Further, the invention relates to a device for storing at least one article of value. The device comprises at least one transport container having at least one opening and being filled with the articles of value to be transported. Further, the device has at least one frame having an opening.

2. Discussion

A device and a method of this type are preferably used in machines for handling notes of value, which can dispense and/or accept notes of value. Notes of value are, for example, banknotes, vouchers or papers of value. It is known to provide notes of value, in particular banknotes, in a stacked manner in cassettes that can be supplied to a cash dispensing machine or a so-called cash recycling machine. Cash recycling machines can accept and check supplied notes of value in a first transaction and again dispense these notes of value in a second transaction. In this connection, known cassettes for notes of value serve as transport containers which, during transport outside of the machine, are closed by suitable security devices and may only be opened by authorized people and with the aid of suitable auxiliary devices. If it is possible to feed notes of value to the machine, the machine determines the value and/or the format of each note of value and, dependent on the value and/or format determined, feeds this note of value to a cassette suitable for this value or this format. When a cassette is filled with notes of value, it can be removed from the machine and then also serves as a transport container.

As transport containers for the notes of value not only cassettes closed on all sides but also thin-walled transport containers, in particular security bags made of foil material, are used. These are, for example, useful when a secured storing unit, such as a suitcase or the like, is available for the transport of these transport containers so that the relatively complex cassettes can be dispensed with.

When all notes of value to be transported have been inserted into the bag, then the bag has to be closed. Advantageously, the bag is closed such that the closure cannot be released or opened non-destructively.

From the non-pre-published document DE 10 2008 023 900.3 a device for stacking notes of value in a transport container is known. The notes of value are fed into the transport container through a front entry area and are stacked on a stacking surface which, with increasing number of inserted notes of value, is adjustable such that a value note stack of predetermined length is formed between a rear press-on device and a front press-on device. In the entry area, a stationary holding frame for holding a receiving bag is arranged, at the circumference of which holding frame a stock of receiving bag material is provided such that the value note stack is formed in the receiving bag and the length of the receiving bag is adapted to the increasing stack length by adjusting the rear press-on device, while the stock is being reduced. The filled receiving bag is welded with the aid of at least two electrodes. What is disadvantageous here is that the value note machine, the transport container and the notes of value are subjected to a high thermal load during welding. This may damage the notes of value and/or the value note machine. Further, a high thermal energy is required for welding. Moreover, it is disadvantageous that, in addition to the holding frame, a welding device is required for closing, which results in additional costs and makes it more difficult to achieve a compact structure.

Alternatively, the filled receiving bag may be closed by a clamping connection. Here, too, it is disadvantageous that, in addition to the holding frame on which the stock of receiving bag material is provided, a further clamping element for closing the receiving bag is required.

It is also possible to glue the opening of the receiving bag together for closing the filled receiving bag. What is disadvantageous here is that the required gluing device is complex and high-maintenance.

Further, the receiving bag may have a zipper at its opening, with the aid of which the filled receiving bag can be closed. The closed zipper is then sealed to avoid unauthorized access to the notes of value contained in the receiving bag or to immediately recognize such unauthorized access. This receiving bag has the disadvantage that the receiving bag volume is independent of the amount of notes of value inserted into the receiving bag. This makes the handling of the receiving bag during transport more difficult. Further, it is disadvantageous that the closing of the zipper and the subsequent sealing are difficult to automate, as a result whereof a cost-intensive manual closing of the receiving bag is required.

SUMMARY OF THE INVENTION

It is an aspect of the invention to specify a method in which a thin-walled transport container is easily filled with at least one article. Further, it is the object of the invention to specify a device for storing at least one article of value, in which device the volume of the transport container is variable dependent on the articles of value to be transported and which can easily be closed.

The invention preferably includes a frame having an opening is contacted by a part of the outside surface of a transport container, which outside surface is turned inside. When the transport container is filled with the supplied articles of value, a part of the transport container is moved through the opening of the frame in feeding direction of the article of value so that at least a part of the inside surface of the transport container that is turned outside is turned inside. Thus, it is achieved that the portion of the outside-turned inside surface of the transport container that is again turned inside increases depending on the size and/or the amount of the articles of value to be transported. As a result thereof, a variable filling volume of the transport container is achieved.

Advantageously, the part of the inside surface of the transport container that is turned inside forms a receiving area for receiving the article of value. The article of value is supplied through a feeding opening, the feeding opening delimiting, opposite to the feeding direction of the articles of value, the part of the inside surface of the transport container that is turned inside.

It is advantageous when an article of value supplied to the transport container as first article of value is pressed against the outside-turned inside surface of the transport container such that the article of value and a part of the transport container are moved at least through a part of the opening of the frame in feeding direction of the article of value. In this way, the transport container can easily be arranged in that it is put over the frame with its outside surface turned inside.

Alternatively, a part of the inside surface of the transport container that is turned outside may be moved through the opening of the frame so that a part of the inside surface of the transport container that is turned outside is turned inside before an article of value supplied to the transport container as first article of value is actually supplied to the transport container. This guarantees that the supplied article of value is held without any further auxiliary means by the receiving area formed in this way for receiving the notes of value.

It is particularly advantageous to close the filled transport container with the aid of the frame. In this way, further additional component parts for closing the frame can be avoided, as a result whereof a more compact structure is achieved and costs are reduced.

Preferably, the transport container is closed with the aid of a snap-in connection formed by at least one first snap-in element of the frame and a second snap-in element of the frame that is complementary to the first snap-in element. Such a snap-in connection is closable by a simple, single-axis movement that can easily be automated.

Further, it is advantageous when the articles of value are automatically supplied to the transport container with the aid of a feeding unit. Such a feeding unit may, for example, be a so-called stacking wheel or a vane wheel. By way of the automatic feeding with the aid of a feeding unit, more articles of value can be supplied to the transport container per time unit than in the case of a manual feeding of the articles of value. Further, automatic feeding is more cost-efficient.

It is advantageous to only close the part of the transport container that is filled with articles of value. In this way, a variable filling volume of the transport container is achieved. By closing only the part of the transport container that is filled with articles of value, an easier handling of the transport container during transport is made possible and manipulation attempts are made more difficult.

Advantageously, the transport container is supported and/or guided by at least one support frame during filling with the articles of value. This provides for a compact filling of the transport container and prevents potential jamming of the articles of value.

Further, the invention relates to a device for storing at least one article of value. The device comprises at least one transport container having at least one opening and at least one frame having an opening. The transport container is arranged such that a part of the outside surface of the transport container, which outside surface is turned inside, contacts the frame and that a part of the transport container is moved through the opening of the frame in feeding direction of the article of value by means of the supplied article of value so that a part of the inside surface of the transport container that is turned outside is turned inside.

It is advantageous when the transport container is a receiving bag. It is particularly advantageous when the receiving bag is made of foil material or tissue material. Such a receiving bag can be obtained in a cost-efficient manner and is easy to handle.

It is advantageous when the frame is stationary during the filling of the transport container with the articles of value. Indeed, the transport container moves relative to the frame, but the frame is stationary relative to the device in which the frame is arranged. In this way, a simple construction of the device can be achieved and a variable filling volume of the transport container is nevertheless possible.

Further, it is advantageous when the transport container has a reinforced bottom that forms a press-on surface for the supplied articles of value. Such a reinforced bottom can, for example, be designed in the form of a folded bottom. In particular, a block bottom bag is used as a transport container.

In a preferred embodiment of the invention, the frame comprises at least one first closing element and a second closing element spaced to the first closing element. The first closing element comprises at least one first snap-in element and the second closing element comprises at least one second snap-in element that is complementary to the first snap-in element. The first and the second closing element are arranged such that at least a part of the opening of the transport container that is opened for feeding the articles of value is arranged between the first and the second closing element and that by a movement of at least one closing element with a part of the transport container arranged between the two closing elements a snap-in connection can be formed between the first snap-in element and the second snap-in element.

It is particularly advantageous when the snap-in connection formed by the first snap-in element and the second snap-in element cannot be released non-destructively. In this way, it is achieved that unauthorized access to the articles of value received in the transport container can be prevented or is made more difficult or such unauthorized access is at least recognized immediately.

The articles of value are preferably notes of value, in particular banknotes.

The device specified by the independent device claim can be developed in the same manner as the method according to the invention. In particular, the device can be developed with the features specified in the dependent method claims or with respective device features.

Further features and advantages of the invention result from the following description which in connection with the enclosed Figures explains the invention in more detail with reference to embodiments.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
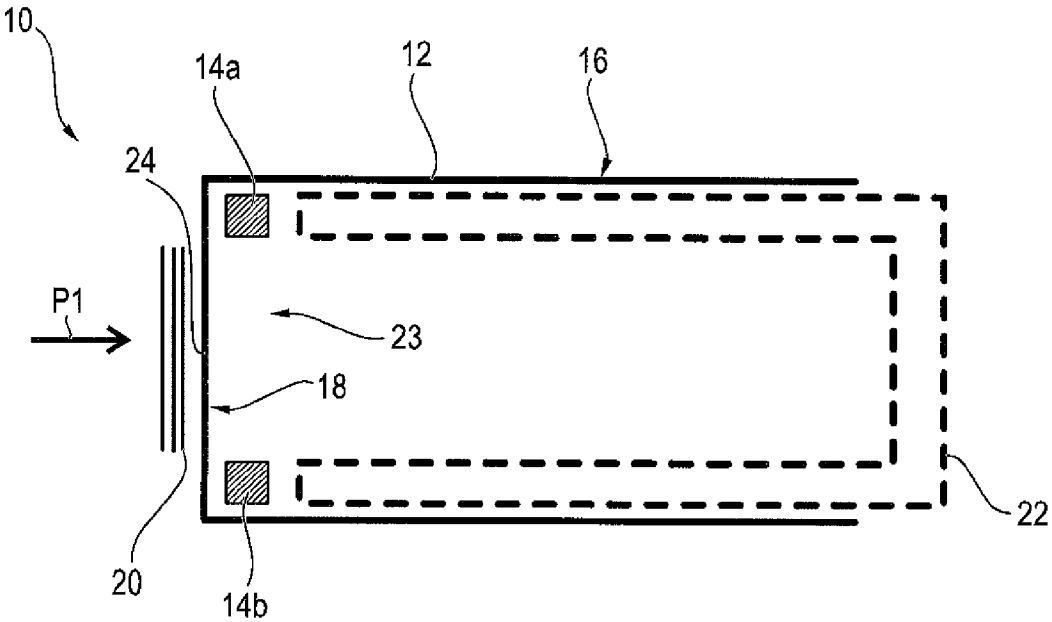
FIG. 1 shows a schematic illustration of a cross-section of a device for storing at least one article of value in an unfilled state.

In FIG. 1, a schematic illustration of a cross-section of a device 10 for storing at least one article of value 20 is shown. The device 10 is shown in a central longitudinal section.

The device 10 comprises a transport container 12 and a frame. The frame comprises two closing elements 14*a*, 14*b*. In a preferred embodiment, the two closing elements 14*a*, 14*b* can be connected to each other via two non-illustrated connecting elements. The two closing elements 14*a*, 14*b* and the non-illustrated connecting elements preferably form a closed frame. This frame is identified in the following with the reference sign 14. The frame 14 has an opening 23 which is at least as large as the largest article of value 20 to be transported.

The transport container 12 is a thin-walled flexible transport container 12. Advantageously, the transport container 12 is a receiving bag. The receiving bag is in particular made of foil material or tissue material. The receiving bag 12 has an inside surface 16 and an outside surface 18. The side which is on the inside in the filled state, i.e. faces the articles of value, is referred to as the inside surface 16. The side which faces outwardly in the filled state, i.e. faces away from the articles of value, is referred to as the outside surface.

The transport container 12 is arranged such that a part of the outside surface 18 of the transport container, which outside surface 18 is turned inside, contacts the frame 14. For this, the transport container 12 is turned inside out before it is pulled over the frame 14. When the transport container 12 is turned inside out, the inside surface 16 of the transport container 12 is turned outside and the outside surface 18 is turned inside. Figuratively speaking, this turning inside out can be understood as turning the transport container 12 to the wrong side. Advantageously, the transport container 12 is fed to the device 10 such that the inside surface 16 is already turned outside and that it is no longer necessary to turn the transport container 12 inside out when the transport container is mounted.

The device 10 is preferably used in value note machines, in particular in automated teller safes, cash deposit machines and cash recycling machines. Here, the articles of value to be transported are notes of value, in particular banknotes. One of these banknotes is exemplarily identified with the reference sign 20.

The banknotes 20 are input into an input compartment of the automated teller machine by a user of the automated teller machine, separated with the aid of a separating device and fed to the safe of the automated teller machine via a transport mechanism. The device 10 for the transport of articles of value is arranged in the safe of the automated teller machine. The banknotes 20 are preferably individually fed to the device 10 in feeding direction P1 with the aid of a stacking wheel.

In the unfilled state of the device 10 illustrated in FIG. 1, the transport container 12 is arranged such that a bottom 24 of the transport container 12 is arranged completely outside the opening 23 of the frame 14. The bottom 24 of the transport container 12 faces the supplied banknotes 20 with its inside surface. With the aid of a feeding device, a first supplied banknote 20 is pressed against the inside surface 16 of the transport container 12 that is turned inside out. In this way, the banknote 20 and a part of the transport container 12 are moved at least through a part of the opening 23 of the frame 14.

A second supplied banknote 20 is pressed against the first supplied banknote 20, as a result whereof the first and the second banknote as well as a part of the transport container 12 are moved further in feeding direction P1 at least through a part of the opening 23 of the frame 14. This process is continued step-by-step by feeding further banknotes 20. In this way, the inside surface 16 of the transport container 12 that is turned outside is again turned inside in a step-by-step manner. In other words, the transport container 12 is again turned to the right side. Given a high feeding speed of the banknotes 20 in feeding direction P1, the inside surface 16 of the transport container 12 that is turned outside can also be turned inside in a continuous movement.

In an alternative embodiment of the invention, a part of the inside surface 16 of the transport container 12 that is turned outside can be turned inside in the unfilled state before a first banknote 20 is fed to the transport container 12. In this way, it is achieved that the banknote 20 that is supplied as first banknote can bear, at its bottom, against the inside surface 16 of the transport container 12 that is turned inside.

Figure 2:
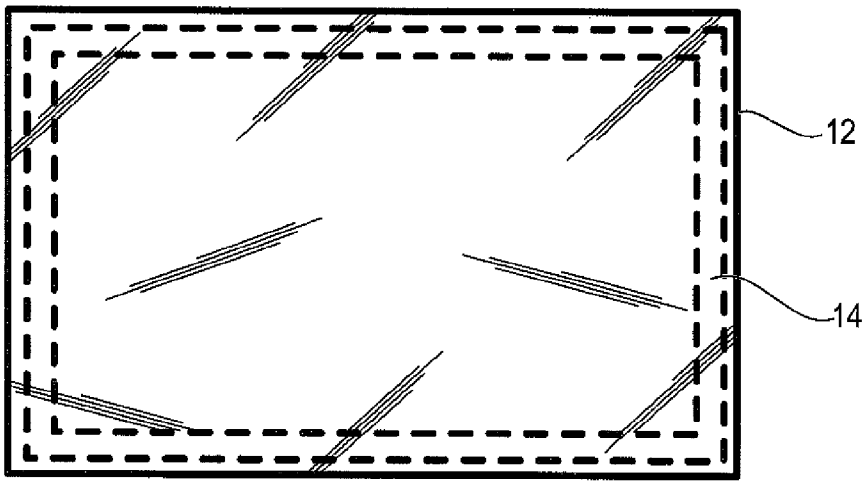
FIG. 2 shows a schematic illustration of a front view of the device according to FIG. 1.

In FIG. 2, a schematic illustration of a front view of the device 10 according to FIG. 1 is shown. Elements having the same structure or the same function are identified with the same reference signs. The frame 14 is arranged within the transport container 12, the inside surface of which is turned outside, and is thus covered by the transport container 12. This is why the frame 14 is illustrated in broken lines. In the unfilled state illustrated in FIG. 2, no banknote 20 has been fed to the transport container 12 yet. Such a transport container 12, whose inside surface is turned outside, is also referred to as a transport container 12 that is turned to the wrong side or turned inside out.

Figure 3:
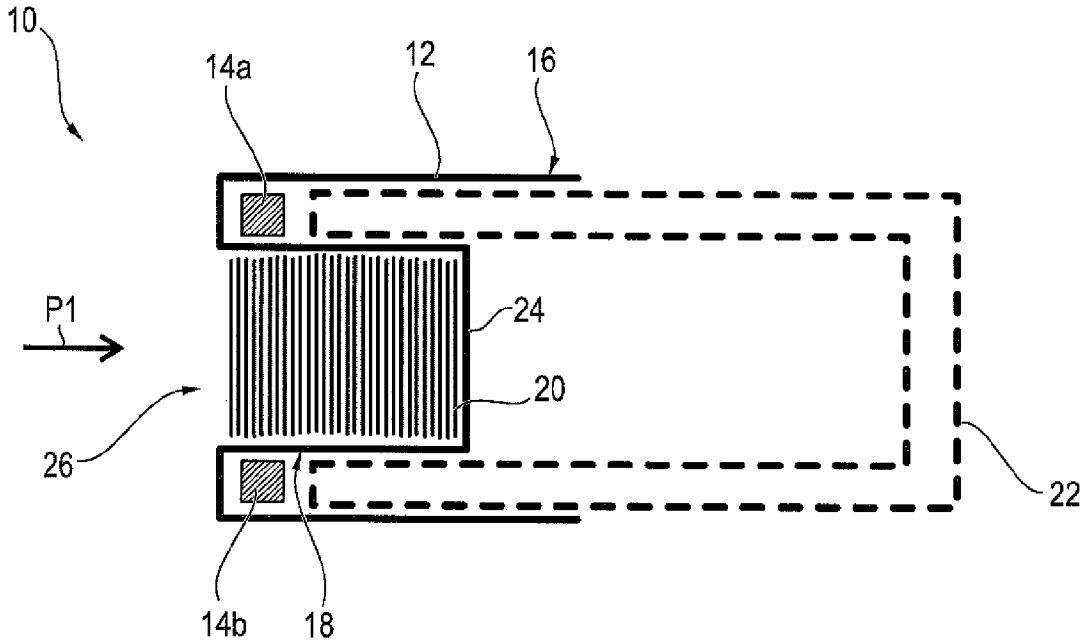
FIG. 3 shows a schematic illustration of a cross-section of the device according to FIGS. 1 and 2 in a partially filled state.

In FIG. 3, a schematic illustration of a cross-section of the device 10 according to FIGS. 1 and 2 is shown in a partially filled state. In this partially filled state, already a large number of banknotes 20 has been supplied to the transport container 12. The supplied banknotes 20 are received in a receiving area formed by the inside surface 16 of the transport container 12 that is turned inside. With each further banknote 20 that is supplied, the receiving area of the transport container 12 is increased in that the bottom 24 of the transport container 12 is moved further in feeding direction P1 of the banknotes 20 and a part of the inside surface 16 of the transport container 12 that is turned outside is turned inside. The banknotes 20 are fed into the receiving area of the transport container 12 via a feeding opening 26.

As the receiving area of the transport container 12 is increased by each further banknote 20 that is supplied, a variable filling volume of the transport container 12 can be achieved. The volume of the transport container 12 is always only as large as required for receiving the supplied banknotes 20.

Advantageously, the bottom 24 of the transport container 12 is reinforced to form a stable press-on surface for the supplied banknotes 20. The bottom 24 is, in particular, a rectangular folded bottom.

In the embodiment illustrated in FIGS. 1 to 3, the transport container 12 that has been filled or that is to be filled is supported and guided during feeding of the banknotes 20 by a support frame 22 illustrated in broken lines. In this way, it is prevented that the thin-walled transport container 12 folds downward due to the weight of the supplied banknotes 20 so that the banknotes 20 received by the transport container 12 are no longer parallel to the supplied banknotes 20 and/or a part of the inside surface 16 of the transport container 12 that is turned outside is turned inside just by the weight of the already supplied banknotes 20 although no further banknote 20 is supplied to the transport container 12. In other embodiments, however, the support frame 22 can be dispensed with. Therefore, the support frame is illustrated in broken lines in FIGS. 1, 3 and 4.

Figure 4:
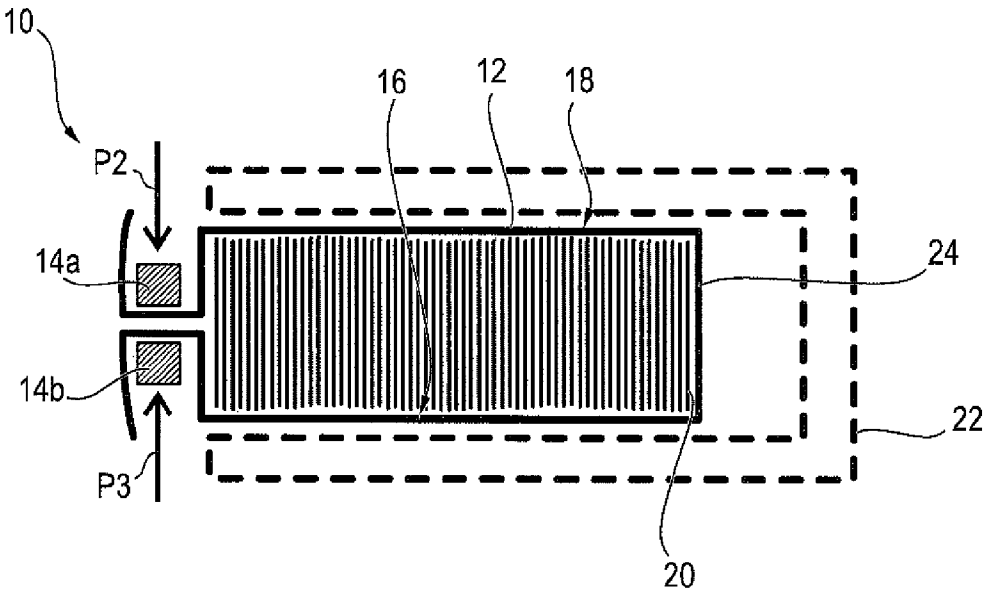
FIG. 4 shows a schematic illustration of a cross-section of the device according to FIGS. 1 to 3 in a filled state.

In FIG. 4, a schematic illustration of a cross-section of the device 10 according to FIGS. 1 to 3 is shown in a filled state. In the filled state, all banknotes 20 to be transported have been fed to the transport container 12. The inside surface 16 of the transport container 12 is preferably completely turned inside. The last banknote 20 supplied to the transport container 20 has been moved with the aid of the feeding unit completely through the opening 23 of the frame 14 in feeding direction P1 toward the bottom 24 of the transport container 12.

The transport container 12 is closed with the aid of the frame 14 in that the first closing element 14*a* and the second closing element 14*b* are moved toward each other in the direction of the arrows P2, P3. Here, only the part of the transport container 12 is closed that is actually filled with banknotes 20. In this way, a variable filling volume of the transport container 12 is achieved and an easier handling of the transport container 12 is made possible.

During the filling of the transport container 12 with the banknotes 20, the frame 14 is stationary. The transport container 12 moves relative to the frame 14 during the feeding of the banknotes 20 into the transport container 12. As the frame 14 is stationary, the feeding opening 26 is likewise stationary. In this way, the feeding of the banknotes 20 into the transport container 12 can easily be carried out in an automated fashion. Further, also the closing of the transport container 12 with the aid of the frame 14 can be easily carried out in an automated manner.

In a preferred embodiment of the invention, the first closing element 14*a* of the frame 14 comprises a first snap-in element and the second closing element 14*b* of the frame comprises a second snap-in element that is complementary to the first snap-in element. The first closing element 14*a* and the second closing element 14*b* are arranged such that at least a part of the feeding opening 26 of the transport container 12 that is opened for feeding the banknotes 20 is arranged between the first closing element 14*a* and the second closing element 14*b* and that by means of a movement of at least one closing element 14*a*, 14*b* with a part of the transport container 12 arranged between the closing elements 14*a*, 14*b* a snap-in connection can be formed between the first snap-in element and the second snap-in element. The snap-in connection formed by the first snap-in element and the second snap-in element cannot be released non-destructively. In this way, unauthorized access to the banknotes 20 received in the transport container is prevented or at least made more difficult, or unauthorized access is at least recognized immediately. Alternatively, the transport container 12 may also be closed with the aid of thermal processes, in particular welding or shrinking, with the aid of a clamping element and/or by adhesion.

Figure 5:
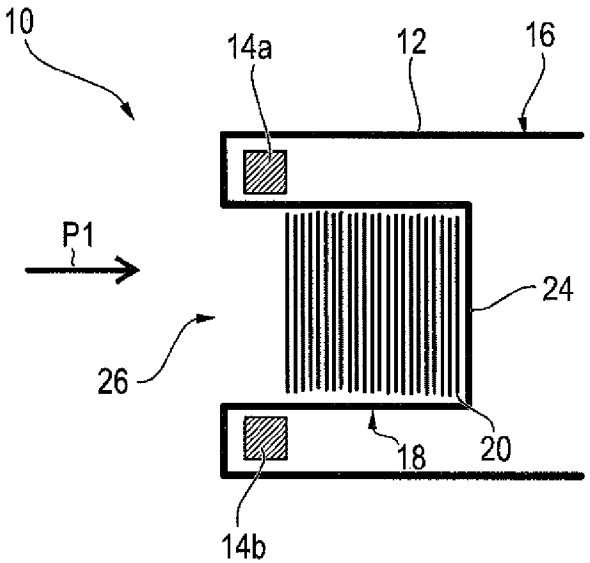
FIG. 5 shows a schematic illustration of a cross-section of the device according to FIG. 2 in a partially filled state without the support frame.

In FIG. 5, a schematic illustration of a cross-section of a device 10 according to FIGS. 1 to 4 is illustrated in the partially filled state according to FIG. 2 without the support frame 22.

Figure 6:
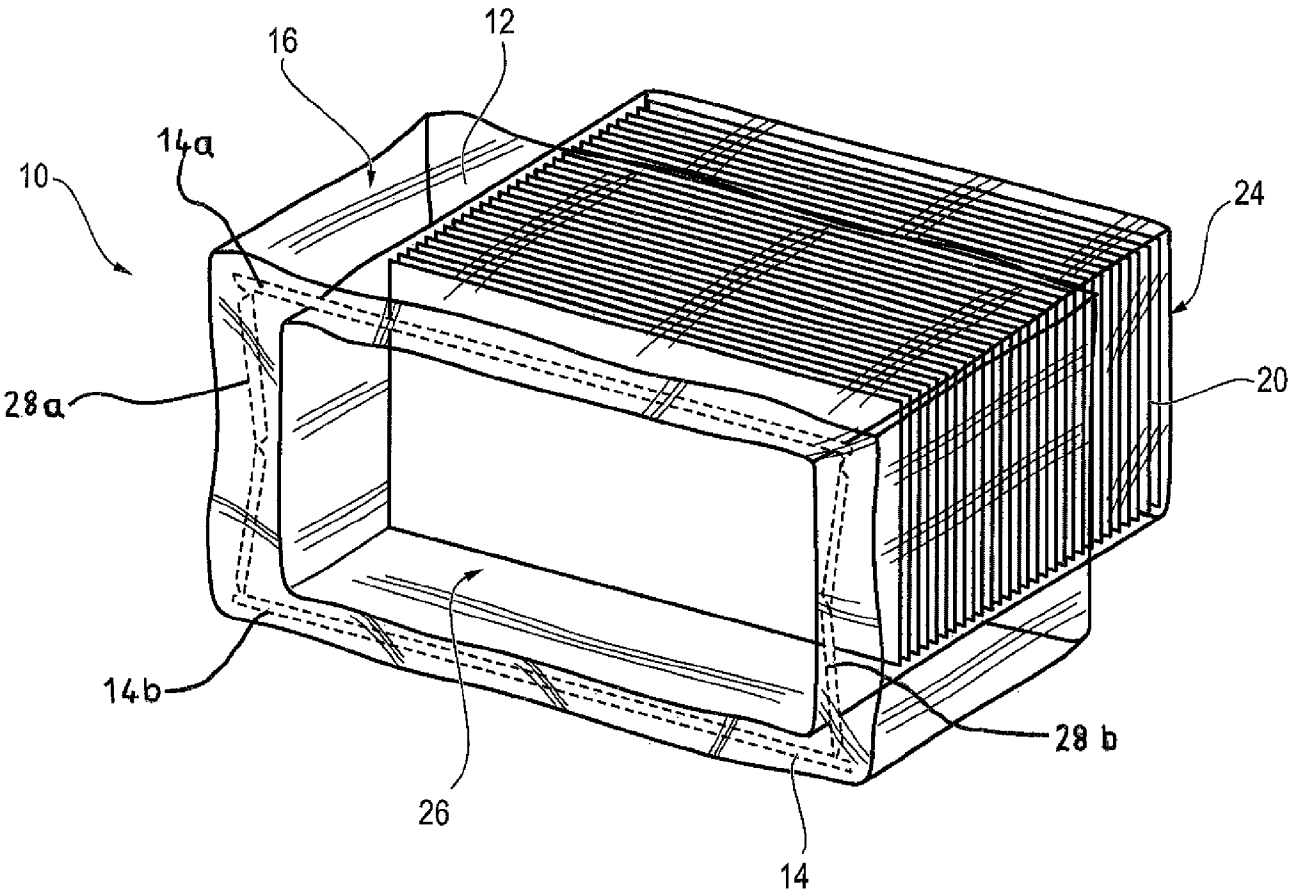
FIG. 6 shows a perspective schematic illustration of the device according to FIG. 5.

In FIG. 6, a schematic perspective illustration of the device 10 according to FIG. 5 is shown. The frame 14 is illustrated in broken lines.

In a particularly advantageous embodiment of the invention, the first closing element 14*a* and the second closing element 14*b* are connected to each other via two connecting elements 28*a*, 28*b*. The longitudinal axes of the first closing element 14*a* and of the second closing element 14*b* are arranged parallel to each other. The first connecting element 28*a* and the second connecting element 28*b* are arranged axially symmetrically with respect to an axis that is orthogonal to the longitudinal axis of the first closing element 14*a* and of the second closing element 14*b* and that extends through the centers of the first closing element 14*a* and of the second closing element 14*b*. The connecting elements 28*a*, 28*b* are designed in the form of film hinges. Alternatively, also other connecting elements may be used.

The closing elements 14*a* and 14*b* and the connecting elements 28*a* and 28*b* together form a closed frame 14. Preferably, the closing elements 14*a*, 14*b* and the connecting elements 28*a*, 28*b* are integrally formed.

During the closing of the device 10, the closing elements 14*a*, 14*b* are moved toward each other. Here, the connecting elements 28*a*, 28*b* are folded further in the direction of the transport container 12 until they are arranged almost parallel to the closing elements 14*a*, 14*b*. Here, the transport container 12 is folded-in with the aid of the connecting elements 28*a*, 28*b* at the sides facing the connecting elements 28*a*, 28*b*. In this way, access to the banknotes received in the transport container 12 is made more difficult in the case of a manipulation attempt. Further, by means of the connecting elements 28*a*, 28*b* a guiding of the transport container 12 on the sides facing the connecting elements 28*a*, 28*b* is achieved. This prevents that, when the closing elements 14*a*, 14*b* are brought together, a part of the transport container 12 is laterally forced out next to the closing elements 14*a*, 14*b* that have been brought together, which would make unauthorized access to the articles of value received in the transport container 12 easier.

Each of the connecting elements 28*a*, 28*b* comprises at its end at the side facing the transport container 12 one non-illustrated guiding element. The guiding elements are rounded-off at the side facing the transport container 12. The guiding elements serve to keep the transport container 12 at a distance to the edges of rails (not shown) arranged at the closing elements 14*a*, 14*b* and thus to prevent damage to the transport container 12 when it is guided past. Further, by means of the guiding elements it is prevented that the transport container 12 is jammed between the connecting elements 28*a*, 28*b* and the rails when the transport container 12 is guided past during its filling, and thus that it might be damaged.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A method for filling at least one thin-walled transport container with at least one article of value, comprising:

in which a frame having an opening is contacted by a part of the outside surface of a transport container, which outside surface is turned inside, a part of the transport container being moved through the opening of the frame in feeding direction of the article of value by means of the article of value supplied during filling so that at least a part of the inside surface of the transport container that is turned outside is turned inside;

wherein the at least one article of value is at least one banknote;

wherein the at least one thin-walled transport container is made of foil material;

wherein the filled transport container is closed with the aid of the frame; and wherein the transport container is closed with the aid of a snap-in connection formed by at least one first snap-in element of the frame and a second snap-in element of the frame that is complementary to the first snap-in element.

2. The method according to claim 1, wherein the part of the inside surface of the transport container that is turned inside forms a receiving area for receiving the article of value.

3. The method according to claim 1, wherein an article of value supplied to the transport container as first article of value is pressed against the outside-turned inside surface of the transport container such that the article of value and a part of the transport container are moved at least through a part of the opening of the frame in feeding direction of the article of value.

4. The method according to claim 1, wherein a part of the inside surface of the transport container that is turned outside is moved through the opening of the frame so that a part of the inside surface of the transport container that is turned outside is turned inside before an article of value supplied to the transport container as first article of value is supplied to the transport container.

5. The method according to claim 1, wherein the transport container is closed automatically.

6. The method according to claim 1, wherein the article of value is automatically supplied to the transport container with the aid of a feeding unit.

7. The method according to claim 1, wherein only the part of the transport container that is filled with articles of value is closed.

8. The method according to claim 1, wherein the transport container is guided by at least one support frame during the filling with the articles of value.

9. The method of claim 1, further comprising closing the transport container by moving a first closing element of the frame and a second closing element of the frame together.

10. A device for transporting at least one article of value, comprising:

a transport container having at least one opening, and at least one frame having an opening, the transport container being arranged such that a part of the outside surface of the transport container, which outside surface is turned inside, contacts the frame, and that the supplied article of value moves a part of the transport container through the opening of the frame in feeding direction of the article of value and turns a part of the outside-turned inside surface of the transport container inside;

wherein the at least one article of value is at least one banknote;

wherein the transport container is made of foil material;

wherein the frame includes at least one first closing element and a second closing element spaced from the first closing element, wherein the first closing element includes at least one first snap-in element and the second closing element comprises at least one second snap-in element that is complementary to the first snap-in element, and wherein the first closing element and the second closing element are arranged such that at least a part of the opening of the transport container that is opened for feeding the articles of value can be arranged between the first closing element and the second closing element wherein movement of at least one closing element with a part of the transport container arranged between the closing elements forms a snap-in connection between the first snap-in element and the second snap-in element.

11. The device according to claim 10, wherein the transport container is a receiving bag.

12. The device according to claim 10, wherein the frame is stationary during the filling of the transport container.

13. The device according to claim 10, wherein the snap-in connection formed by the first snap-in element and the second snap-in element cannot be released non-destructively.

14. The device according to claim 10, wherein the frame includes a first closing element and a second closing element spaced apart from the first closing element, the first closing element and the second closing element are arranged such that at least a part of the opening of the transport container that is opened for feeding the articles of value can be arranged between the first closing element and the second closing element; and wherein moving the first closing element and the second closing element together closes the transport container.

15. A system for transporting banknotes comprising:

a transport container including a final outer surface and a final inner surface, the transport container made of a foil material;

a frame defining a frame opening, the frame including a first closing element and a second closing element;

wherein:

prior to loading the transport container with banknotes, the transport container is arranged such that the final inner surface is turned outward, the final outer surface is turned inward, and the final outer surface contacts the frame;

movement of the banknotes in a feeding direction during loading of the transport container pushes a portion of the transport container through the frame opening such that: a bottom portion of the container passes completely through the frame opening; the final inner surface turns inward to define a feeding opening and a banknote receiving area in which the banknotes are stored; and the final outer surface turns outward; and movement of the first and the second closing elements together closes the feeding opening to seal the banknotes within the transport container.

16. The system of claim 15, wherein the first closing element includes a first snap-in element and the second closing element includes a second snap-in element, movement of the first and the second closing elements together provides a snap-in connection closing the feeding opening and sealing the banknotes within the transport container.

17. The system of claim 15, further comprising a first connecting element and a second connecting element each connecting the first and the second closing elements together.

* * * * *